US011028467B2

(12) United States Patent
Takayama et al.

(10) Patent No.: US 11,028,467 B2
(45) Date of Patent: Jun. 8, 2021

(54) METAL-BASED COMPOSITE MATERIAL

(71) Applicant: TYK CORPORATION, Minato-ku (JP)

(72) Inventors: Sadayasu Takayama, Tajimi (JP); Shinji Kajita, Tajimi (JP); Yukie Kaku, Tajimi (JP)

(73) Assignee: TYK CORPORATION, Minato-ku (JP)

( * ) Notice: Subject to any disclaimer, the term of this patent is extended or adjusted under 35 U.S.C. 154(b) by 0 days.

(21) Appl. No.: 16/607,632

(22) PCT Filed: Apr. 19, 2018

(86) PCT No.: PCT/JP2018/016058
§ 371 (c)(1),
(2) Date: Oct. 23, 2019

(87) PCT Pub. No.: WO2018/198913
PCT Pub. Date: Nov. 1, 2018

(65) Prior Publication Data

US 2020/0095654 A1 Mar. 26, 2020

(30) Foreign Application Priority Data

Apr. 28, 2017 (JP) ..... JP2017-090766

(51) Int. Cl.
*C22C 14/00* (2006.01)
*C22C 1/05* (2006.01)

(52) U.S. Cl.
CPC ..... *C22C 14/00* (2013.01); *C22C 1/05* (2013.01)

(58) Field of Classification Search
None
See application file for complete search history.

(56) References Cited

U.S. PATENT DOCUMENTS

2015/0064046 A1 3/2015 Kondoh et al.

FOREIGN PATENT DOCUMENTS

| | | | |
|---|---|---|---|
| CN | 102925737 | A | 2/2013 |
| CN | 103526074 | A | 1/2014 |
| CN | 108149053 | A | 6/2018 |
| JP | 7-84601 | B2 | 9/1995 |
| JP | 8-170140 | A | 7/1996 |
| JP | 10-72648 | A | 3/1998 |
| JP | H 1072648 | * | 3/1998 |

OTHER PUBLICATIONS

International Search Report dated Jun. 12, 2018 in PCT/JP2018/016058 filed on Apr. 19, 2018.

(Continued)

*Primary Examiner* — Daniel J. Schleis
(74) *Attorney, Agent, or Firm* — Oblon, McClelland, Maier & Neustadt, L.L.P.

(57) ABSTRACT

Provided is a metal-based material having a high hardness. A metal-based composite material of the present invention is formed from a sintered body obtained from Ti material powder, Mo material powder, Ni material powder, and ceramics powder, and 0.1 to 9 parts by mass of Ni is contained with respect to 100 parts by mass of the entirety of the metal-based composite material.

7 Claims, 3 Drawing Sheets

(56) References Cited

OTHER PUBLICATIONS

Written Opinion of the International Searching Authority dated Jun. 12, 2018 in PCT/JP2018/016058 filed on Apr. 19, 2018 (with unedited computer generated English translation), (total 8 pages).
Written Opinion (dated Oct. 16, 2018, 5 pages) and International Preliminary Report on Patentability (dated Feb. 5, 2019, 3 pages) of the International Preliminary Examining Authority (with unedited computer generated English translation of the Written Opinion), (total 11 pages).
Takayama, S. et al., "Developments of Ti matrix composite-used shot sleeve "TC sleeve" for longer life," Transactions, 2016 Japan Die Casting Congress, Nov. 24-26, 2016, pp. 111-118, (with English abstract), (total 14 pages).
Combined Chinese Office Action and Search Report dated Nov. 16, 2020 in Chinese Patent Application No. 201880027635.7 (with unedited computer generated English translation of Office Action and English Translation of Category of Cited Documents), 8 pages.

* cited by examiner

METAL-BASED COMPOSITE MATERIAL

TECHNICAL FIELD

The present invention relates to a metal-based composite material.

BACKGROUND ART

In recent years, in the fields of automobiles, industrial machinery, household electrical appliances, and the like, opportunities to use light-weight non-ferrous metals such as aluminium have been increased. Some of non-ferrous metals such as aluminium alloys are cast by using die-casting technology (that is, using a die-casting machine) at a high speed with high accuracy, in many cases.

A metal-based composite material is used for an injection sleeve of a die-casting machine as described in Patent Literature 1 in some cases. The metal-based composite material is disposed at a portion that is brought into contact with molten metal, by shrink fitting or enveloped casting.

CITATION LIST

Patent Literature

Patent Literature 1: JP 7-84601 B

SUMMARY OF INVENTION

Technical Problem

In a die-casting machine, an injection sleeve formed by using a metal-based composite material is required to have further improved durability. In particular, the metal-based composite material is required to have an enhanced hardness.

The present invention is made in view of the aforementioned circumstances, and an object of the present invention is to provide a metal-based composite material having a high hardness.

Solution to Problem

In order to solve the aforementioned problem, a metal-based composite material of the present invention is formed from a sintered body obtained from Ti material powder containing Ti, Mo material powder containing Mo, Ni material powder containing Ni, and ceramics powder of at least one selected from SiC, TiC, $TiB_2$, and MoB, and 0.1 to 9 parts by mass of Ni is contained with respect to 100 parts by mass of the entirety of the metal-based composite material.

The metal-based composite material of the present invention allows hardness (and strength, wear resistance) to be improved by densifying a structure.

DESCRIPTION OF EMBODIMENTS

Figure 1:
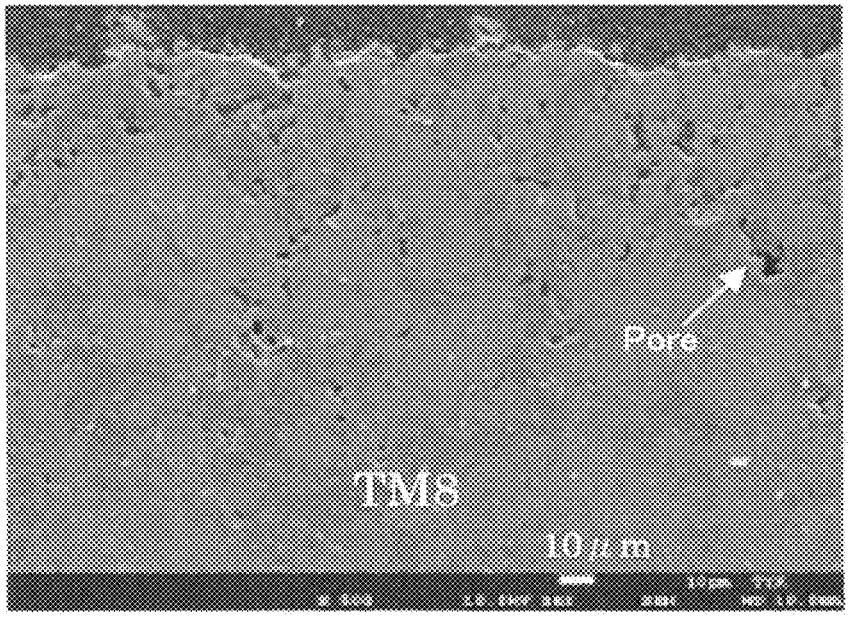
FIG. 1 shows an enlarged photograph of a cross-section of a sample 1 according to an example.

The present invention will be specifically described below based on embodiments.

[Metal-Based Composite Material]

A metal-based composite material according to the present embodiment is formed from a sintered body which is obtained from Ti material powder containing Ti, Mo material powder containing Mo, Ni material powder containing Ni, and ceramics powder of at least one selected from SiC, TiC, $TiB_2$, and MoB. 0.1 to 9 parts by mass of Ni is contained with respect to 100 parts by mass of the entirety of the metal-based composite material.

The metal-based composite material according to the present embodiment is formed from a sintered body. The sintered body is obtained by sintering the material powder. The sintered body has atoms of the materials dispersed therein, and the structure is not generally specified. That is, the sintered body of the present embodiment is a sintered body which is obtained from Ti material powder containing Ti, Mo material powder containing Mo, Ni material powder containing Ni, and ceramics powder of at least one selected from SiC, TiC, $TiB_2$, and MoB, and a microscopic structure and characteristics are not generally determined.

The metal-based composite material according to the present embodiment is formed from a sintered body obtained from Ti material powder, Mo material powder, Ni material powder, and ceramics powder. The sintered body formed from these kinds of the powders contains Ti and Mo, and ceramics and Ni.

The Ti material powder is powder (aggregate of compound particles) of a compound containing Ti in the composition. The Ti material powder is preferably powder of (particles of) a compound in which Ti is a component having the greatest content in the compound, is preferably powder of (particles of) a compound containing 50 mass % or more of Ti, is more preferably powder of (particles of) a compound containing 90 mass % or more of Ti, and is most preferably powder of (particles of) Ti. The content proportion in each compound is a content proportion in the case of the mass of the entire Ti material powder being 100 mass %. The Ti material powder may be formed by (particles of) compounds having different Ti content proportions being combined.

The Mo material powder is powder (aggregate of compound particles) of a compound containing Mo in the composition. The Mo material powder is preferably powder of (particles of) a compound in which Mo is a component having the greatest content in the compound, is preferably powder of (particles of) a compound containing 50 mass or more of Mo, is more preferably powder of (particles of) a compound containing 90 mass % or more of Mo, and is most preferably powder of (particles of) Mo. The content proportion in each compound is a content proportion in the case of the mass of the entire Mo material powder being 100 mass %. The Mo material powder may be formed by (particles of) compounds having different Mo content proportions being combined.

The ceramics powder is powder formed from at least one kind of ceramics selected from SiC, TiC, $TiB_2$, and MoB. The ceramics powder is powder of one kind of ceramics selected from SiC, TiC, $TiB_2$, and MoB, or mixed powder containing powders of two or more kinds of the ceramics. The ceramics powder may be powder formed by a composite of two or more kinds of ceramics selected from SiC, TiC, $TiB_2$, and MoB. A ratio among the two or more kinds of ceramics selected from SiC, TiC, $TiB_2$, and MoB in the case of the ceramics powder being formed from the two or more kinds of ceramics is not specifically limited The Ni material powder is powder (aggregate of compound particles) of a compound containing Ni in the composition. The Ni material powder is preferably powder of (particles of) of a compound in which Ni is a component having the greatest content in the compound, is preferably powder of (particles of) of a compound containing 50 mass % or more of Ni, is more preferably powder of (particles of) of a compound containing 90 mass % or more of Ni, and is most preferably powder of (particles of) Ni. The content proportion in each compound is a content proportion in the case of the mass of the entire Ni material powder being 100 mass %. The Ni material powder may be formed by (particles of) of compounds having different Ni content proportions being combined.

Each of the Ti material powder, the Mo material powder, and the Ni material powder may form an alloy with another element among Ti, Mo, and Ni. Examples of the alloy include a Ti—Mo alloy.

The metal-based composite material according to the present embodiment contains 0.1 to 9 parts by mass of Ni with respect to 100 parts by mass of the entirety of the metal-based composite material. The parts by mass of Ni correspond to a proportion of the total mass of Ni contained in the metal-based composite material. That is, the parts by mass may be converted to % by mass (mass %).

Ni densifies the structure of the metal-based composite material. When the structure is densified, the hardness and strength are increased over the entirety. That is, when Ni is contained, wear resistance of the metal-based composite material is improved.

When 0.1 to 9 parts by mass of Ni is contained, the effect of improving the wear resistance is assuredly exhibited. When the content of Ni is less than 0.1 parts by mass, the content of Ni to be blended is excessively small, and the effect obtained by the blending is not sufficiently exhibited. When the content of Ni is increased so as to be greater than 9 parts by mass, the metal-based composite material becomes brittle. That is, bending resistance is reduced.

A content proportion of Ni is preferably 0.1 to 5 parts by mass with respect to 100 parts by mass of the entirety of the metal-based composite material. The content of Ni is more preferably 0.5 to 3 parts by mass.

The metal-based composite material according to the present embodiment contains Ti contained in the Ti material powder and Mo contained in the Mo material powder. Furthermore, the metal-based composite material contains ceramics contained in the ceramics powder.

In the metal-based composite material according to the present embodiment, Ti forms a matrix. In the metal-based composite material according to the present embodiment, the Ti matrix has excellent erosion resistance with respect to molten non-ferrous metal. The Ti matrix has low thermal conductivity and thus has excellent temperature retaining capability.

Mo improves erosion resistance. Particularly, Mo improves erosion resistance with respect to a non-ferrous metal. That is, when Mo is contained, erosion resistance of the metal-based composite material with respect to a non-ferrous metal is improved.

Mo is arranged in a Ti-rich state. The Ti-rich state represents a state where the mass of Ti is greater than the mass of Mo. The preferable proportion is such that 10 to 50 parts by mass of Mo is contained with respect to 100 parts by mass of Ti. The more preferable content proportion is such that 20 to 40 parts by mass of Mo is contained.

Ceramics have excellent strength and hardness. In the sintered body of the metal-based composite material, the ceramics are structured such that particles derived from the material powder are dispersed in the matrix. The ceramics enhance the strength and the hardness of the metal-based composite material. The ceramics further enhance sinterability, and thus contribute to enhancement of the strength and hardness of the metal-based composite material.

When 1 to 15 parts by mass of the ceramics are contained, the effect of enhancing the strength and hardness is exhibited. When the content of the ceramics is less than 1 part by mass, the content of the ceramics to be blended is excessively small, and the effect obtained by the blending is not sufficiently exhibited. That is, the hardness and wear resistance of the metal-based composite material are reduced. When the content of the ceramics is increased so as to be greater than 15 parts by mass, the metal-based composite material becomes brittle, and resistance to impact is thus reduced. The reduction of resistance to impact causes the metal-based composite material to be easily broken.

A preferable content proportion of the ceramics is such that 1 to 15 parts by mass of the ceramics are contained with respect to 100 parts by mass of the total mass of Ti and Mo. The content of the ceramics is more preferably 3 to 10 parts by mass.

The metal-based composite material according to the present embodiment preferably has a porosity of not greater than 0.5%. The metal-based composite material according to the present embodiment is a sintered body having a dense structure as described above. When the porosity is not greater than 0.5%, the metal-based composite material becomes denser and has excellent hardness and strength. The porosity is more preferably not greater than 0.3% and even more preferably not greater than 0.15%.

The metal-based composite material according to the present embodiment is preferably nitrided. That is, the metal-based composite material preferably has a nitrided film on the surface. The nitrided film formed by the nitriding has a high hardness. As a result, the metal-based composite material according to the present embodiment has enhanced surface hardness.

Furthermore, in the metal-based composite material according to the present embodiment, the structure itself has a high hardness as described above. In addition thereto, the metal-based composite material has the nitrided film on the surface. That is, by the nitriding, the metal-based composite material has a higher hardness as compared with a case where the nitriding is not performed.

In the metal-based composite material according to the present embodiment, an effect of enhancing the hardness by the nitriding is lower as compared with a case where a conventional sintered body is nitrided. This is because the metal-based composite material according to the present embodiment contains Ni and thus has a densified structure, and, therefore, the nitriding reaction does not easily progress from the surface of material powder particles into the inside. However, in the metal-based composite material according to the present embodiment, the sintered body itself has a high hardness due to the densification. Thus, even if the nitrided film on the surface is lost or even if the effect by the nitriding is low, a high hardness is obtained.

A method for producing the metal-based composite material according to the present embodiment is not specifically limited. For example, the method for producing the metal-based composite material includes a step of mixing each kind of the material powder, and a step of heating and sintering the mixed powder. The method for producing the metal-based composite material may further include a step of forming the mixed powder into a predetermined shape, and a nitriding step of heating the sintered body under a nitrogen atmosphere. In at least one of timing before the nitriding and timing after the nitriding, a shaping step may be performed.

EXAMPLES

The present invention will be described below based on examples.

The metal-based composite material according to the present invention was actually produced.

Examples and Comparative Examples

For examples and comparative examples, test pieces of metal-based composite materials were produced as samples 1 to 13. Each test piece was a sintered body obtained from Ti powder as the Ti material powder, SiC powder as the ceramics material powder, Mo powder as the Mo material powder, and Ni powder as the Ni material powder.

Each sample contained each of Ti, Mo, SiC, and Ni in parts by mass (mass ratio) as indicated collectively in Table 1.

The porosities of the samples were measured and collectively indicated in Table 1. The porosities were measured by using a measurement method specified in JIS R 2205.

Figure 3:
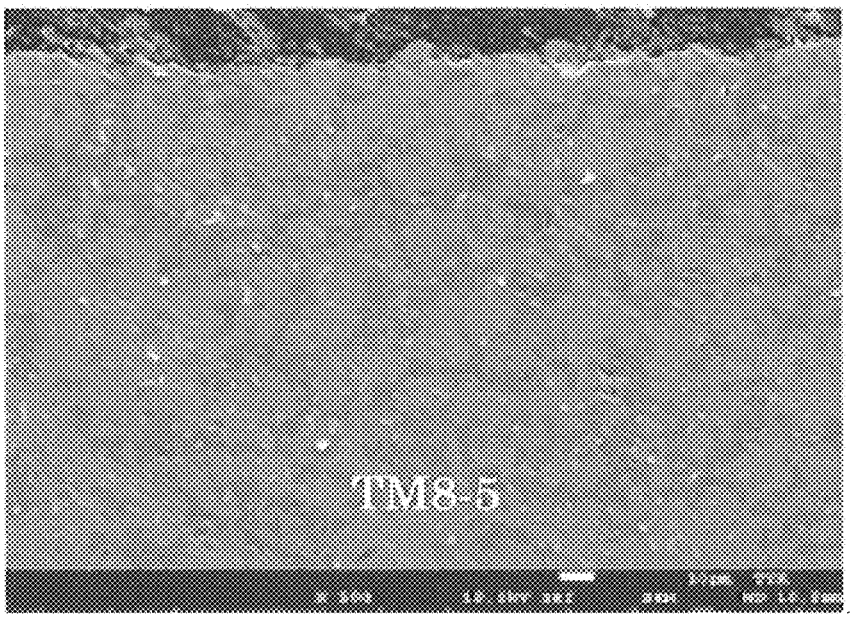
FIG. 3 shows an enlarged photograph of a cross-section of a sample 8 according to an example.
Figure 4:
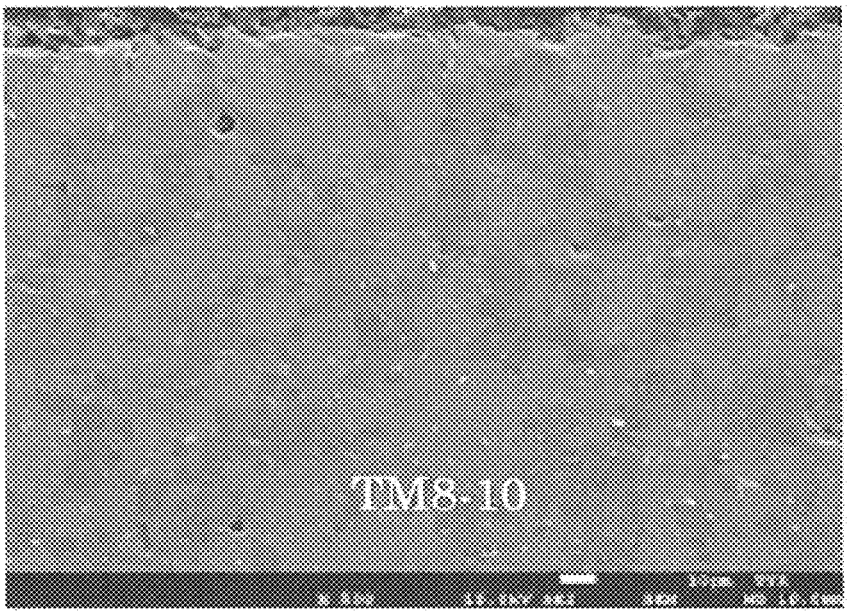
FIG. 4 shows an enlarged photograph of a cross-section of a sample 12 according to an example.

FIG. 3 shows the cross-section of the sample 8. FIG. 4 shows the cross-section of the sample 12.

(Hardness)

For evaluating each sample, a hardness (Rockwell hardness, HRC) was measured. The measurement results are collectively indicated in Table 1.

The Rockwell hardness was measured by using a Rockwell hardness tester (manufactured by Akashi Seisakusho).

(Strength)

For evaluating each sample, a strength (bending strength) was measured. The measurement results are collectively indicated in Table 1.

The bending strength was measured by using an electronic universal material testing machine (manufactured by Yonekura Mfg. Co., Ltd).

(Erosion Resistance)

A columnar test piece having φ10 mm and a length of 100 mm was produced by using each sample. The test piece was immersed from the end portion of the columnar shape to 50 mm into a molten aluminium alloy. An ADC12 material specified in JIS H 5302 was melted in a graphite crucible and used as the molten aluminium alloy. The test piece was immersed for 24 hours in the molten aluminium alloy which was maintained at 680° C. (static immersion).

After the immersion, the test piece was taken out and cooled. Thereafter, the outer diameter was measured at the center portion (located 25 mm from the end portion) of the immersion depth of 50 mm, and a reduced amount (erosion amount) of the outer diameter was obtained. A ratio of the erosion amount of each sample to an erosion amount of the sample 1 was calculated by setting the erosion amount of sample 1 as 100%. The obtained results are collectively indicated in Table 1.

TABLE 1

| Sample | Parts by mass | | | | Porosity | HRC hardness | | Bending | Wear width (mm) | | Erosion |
|---|---|---|---|---|---|---|---|---|---|---|---|
| | | | | | | Internal hardness | Nitrided | strength | When not | Nitrided | rate |
| No. | Ti | Mo | SiC | Ni | (%) | (when not nitrided) | surface hardness | (MPa) | nitrided | surface | (%) |
| 1 | 66.67 | 28.57 | 4.76 | 0.00 | 0.67 | 35.0 | 43.5 | 672 | 1.33 | 1.16 | 100 |
| 2 | 66.60 | 28.54 | 4.76 | 0.10 | 0.50 | 36.4 | 43.1 | 721 | 1.28 | 1.18 | 100 |
| 3 | 66.35 | 28.44 | 4.74 | 0.47 | 0.29 | 37.5 | 41.9 | 798 | 1.26 | 1.20 | 102 |
| 4 | 66.04 | 28.30 | 4.72 | 0.94 | 0.27 | 38.2 | 40.3 | 817 | 1.25 | 1.21 | 105 |
| 5 | 65.42 | 28.04 | 4.67 | 1.87 | 0.09 | 38.8 | 39.7 | 829 | 1.23 | 1.22 | 103 |
| 6 | 64.81 | 27.78 | 4.63 | 2.78 | 0.07 | 40.5 | 40.8 | 796 | 1.23 | 1.22 | 99 |
| 7 | 64.22 | 27.52 | 4.59 | 3.67 | 0.07 | 45.1 | 45.0 | 601 | 1.21 | 1.21 | 97 |
| 8 | 63.64 | 27.27 | 4.55 | 4.55 | 0.081 | 47.3 | 46.5 | 482 | 1.19 | 1.20 | 92 |
| 9 | 63.06 | 27.03 | 4.50 | 5.41 | 0.09 | 47.8 | 48.0 | 393 | 1.10 | 1.08 | 98 |
| 10 | 61.95 | 26.55 | 4.42 | 7.08 | 0.08 | 46.7 | 46.5 | 325 | 1.17 | 1.16 | 102 |
| 11 | 61.40 | 26.32 | 4.39 | 7.89 | 0.10 | 45.1 | 45.2 | 301 | 1.22 | 1.23 | 106 |
| 12 | 60.87 | 26.09 | 4.35 | 8.70 | 0.13 | 44.1 | 42.5 | 280 | 1.30 | 1.29 | 110 |
| 13 | 60.34 | 25.86 | 4.31 | 9.48 | 0.15 | 43.5 | 42.1 | 271 | 1.35 | 1.32 | 116 |

[Evaluation]

The following evaluation was made for each sample (in a non-nitrided state). In the following evaluation, the samples having been nitrided were also measured for a HRC hardness and a wear width. The measurement results after the nitriding are collectively indicated in Table 1.

(Enlarged Photograph)

Figure 2:
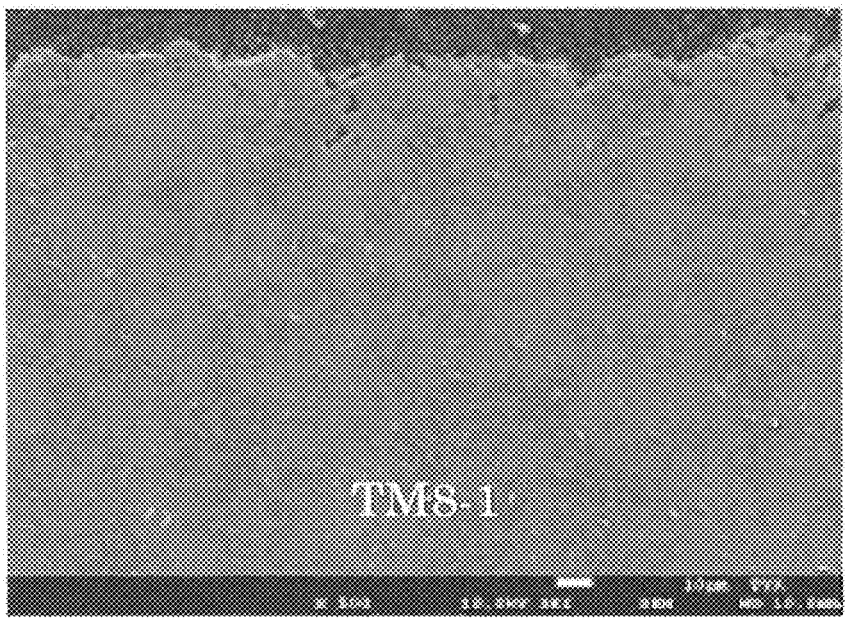
FIG. 2 shows an enlarged photograph of a cross-section of a sample 4 according to an example.

For evaluating each sample, a photomicrograph of the cross-section was taken. The taken photographs are shown in FIG. 1 to FIG. 4. FIG. 1 shows the cross section of the sample 1. FIG. 2 shows the cross-section of the sample 4.

(Wear Resistance)

A wear width was measured by using an Ogoshi-type wear testing machine. The measurement results are indicated in Table 1.

The wear width was measured by using a Riken-Ogoshi-type rapid wear testing machine (manufactured by Tokyo Testing Machine Inc.).

(Evaluation Result)

(Porosity and Enlarged Photograph)

According to Table 1, the sample 1 which did not contain Ni had a high porosity of 0.67%. Meanwhile, each of the samples 2 to 13 containing Ni had a low porosity of not higher than 0.5%. The reduction of the porosity was clear also from the enlarged photographs shown in FIG. 1 to FIG. 4.

According to the enlarged photographs shown in FIG. 1 to FIG. 4, the sample 1 which did not contain Ni had a lot of pores. Meanwhile, each of the samples 4, 8, and 12 each containing Ni at a certain rate had a dense structure having a small number of pores.

(HRC Hardness)

According to Table 1, the sample 1 which did not contain Ni had a low hardness of about 35 HRC. Each of the samples 2 to 13 containing Ni had a higher hardness than the sample 1. Each of the samples 7 to 11 containing 3 to 8 parts by mass of Ni had a hardness of not less than 45 HRC, that is, indicated a great value. Furthermore, the samples 8 to 9 containing 4 to 6 parts by mass of Ni had hardnesses of not less than 47 HRC, that is, indicated the greatest values. That is, the metal-based composite materials of the samples 2 to 12 each containing Ni at a certain rate had high HRC hardnesses.

The nitrided samples each had a higher HRC hardness as compared with a non-nitrided sample. The properties of the HRC hardness after the nitriding are the same as the properties of the HRC hardness in the non-nitrided state. That is, a metal-based composite material has an enhanced HRC hardness by performing the nitriding (that is, having a nitrided film).

(Bending Strength)

According to Table 1, the sample 13 which excessively contained Ni had a bending strength of 271 MPa, that is, had a low strength. Meanwhile, each of the samples 2 to 12 each containing Ni at a certain rate (not greater than 9 parts by mass) had a bending strength of not less than 300 MPa, that is, had a greater value than the sample 13. In particular, each of the samples 2 to 6 containing 0.1 to 3 parts by mass of Ni, had a bending strength of not less than 700 MPa, that is, indicated a great value. Furthermore, each of the samples 4 to 5 containing 0.5 to 2 parts by mass of Ni, had a bending strength of not less than 800 MPa. That is, the metal-based composite material of each of the samples 2 to 12 that contained Ni at a certain rate had a high strength (bending strength).

(Wear Resistance)

According to Table 1, the sample 1 which did not contain Ni had a large wear width of 1.33 mm. That is, the wear resistance was low. Meanwhile, each of the samples 2 to 12 containing Ni at a certain rate had a wear width that was equal to or less than the wear width of the sample 1. That is, the wear resistance was excellent. Particularly, each of the samples 8 to 10 containing 4 to 7.5 parts by mass of Ni had a wear width of not greater than 1.2 mm, that is, indicated a substantially small value. Furthermore, the sample 9 containing 5.41 parts by mass of Ni had a wear width of 1.1 mm, that is, indicated the smallest value.

That is, the metal-based composite material of each of the samples 2 to 12 each containing Ni at a certain rate had a high wear resistance.

Furthermore, when the samples were nitrided, the nitrided sample had a wear width that was equal to or less than a wear width in a non-nitrided state. That is, the samples 2 to 12 containing Ni had excellent wear resistance. The sample 9 containing 5.41 parts by mass of Ni had a wear width of 1.08 mm, that is, indicated the smallest value.

Thus, when nitrided (that is, having a nitrided film), the metal-based composite material had more excellent wear resistance.

(Erosion Resistance)

According to Table 1, an erosion amount was almost the same among the samples. In the samples 12 to 13, the erosion rates exceeded 110%, and the erosion amounts tended to become great. That is, the samples had similar erosion resistances. In this condition, the samples 6 to 9 containing 2 to 6 parts by mass of Ni indicated small erosion rate values, and the sample 8 containing 4.55 parts by mass of Ni had an erosion rate of 92%, that is, indicated the smallest value. That is, the sample 8 containing 4.55 parts by mass of Ni was confirmed to have the most improved erosion resistance.

As described above, each of the samples 2 to 12 each containing Ni at a certain rate had a porosity of not greater than 0.5%, that is, had a dense structure having a small number of pores. As a result, a metal-based composite material having excellent hardness (HRC hardness), strength (bending strength), and wear resistance was confirmed to be obtained.

Furthermore, erosion resistance with respect to an aluminium alloy was also confirmed to be excellent.

Each of the samples 2 to 12 each containing Ni at a certain rate had a porosity of not greater than 0.5%, and had a dense structure having a small number of pores, so that a metal-based composite material having excellent hardness and wear resistance was obtained. Increase of the content of Ni which contributes to improvement of hardness and wear resistance tends to cause embrittlement. This is clear also from the test result of the bending strength of the sample 8 containing 4.55 parts by mass of Ni. When the content of Ni was not less than 9.48 parts by mass, the porosity was not greater than 0.5%. However, the material became brittle and the wear width tended to increase. The bending strength also tended to be reduced so as to be less than 300 MPa.

[Test Using Actual Machine]

The sample 1 and the sample 2 were each applied to an injection sleeve of a die-casting machine, and an increased amount of a dimension was measured after repeated shots.

Figure 5:
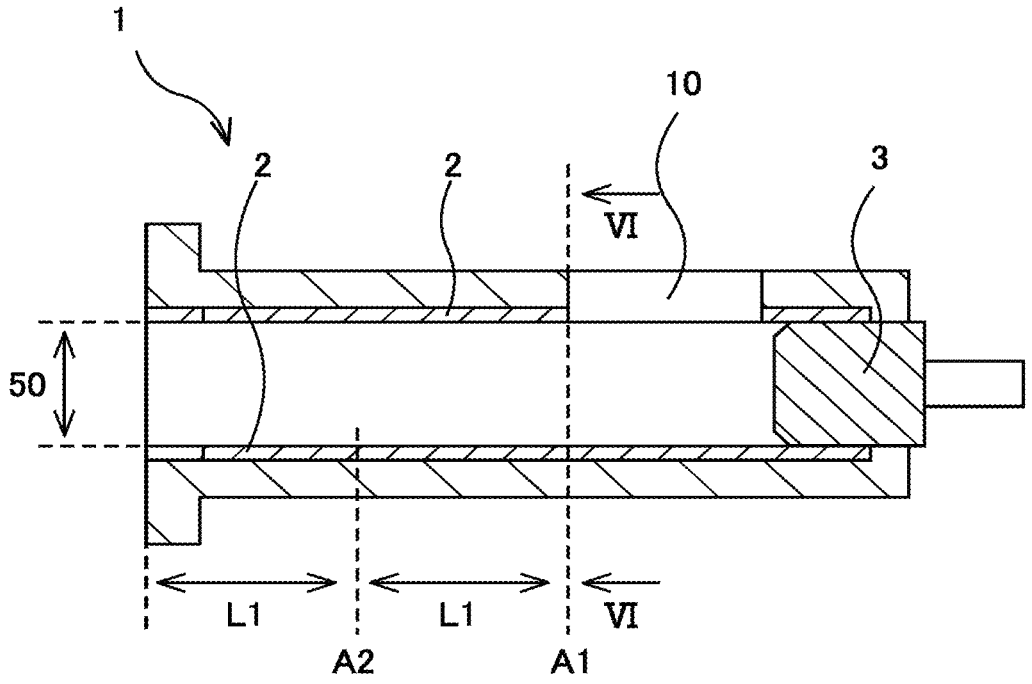
FIG. 5 is a cross-sectional view illustrating a structure of an injection sleeve of a die-casting machine.
Figure 6:
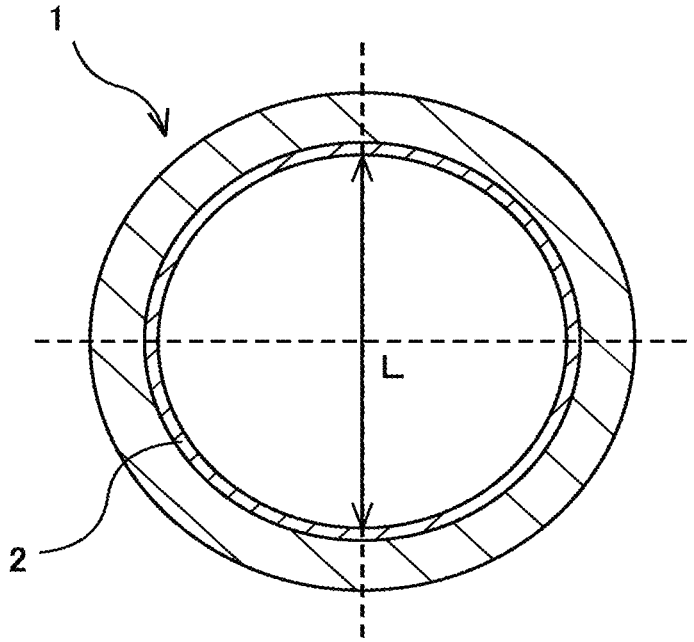
FIG. 6 is a cross-sectional view taken along a line VI-VI in FIG. 5.

As the die-casting machine, a 125 ton horizontal-type machine (manufactured by TOYO MACHINERY & METAL CO., LTD., trade name: BD-125V4T) was used. The die-casting machine had an injection sleeve 1 having an inner diameter of φ50 mm, as shown in FIG. 5 to FIG. 6. FIG. 5 is a cross-sectional view along the axial direction of the injection sleeve 1. FIG. 6 is a cross-sectional view taken along a line VI-VI in FIG. 5.

A metal-based composite material 2 of each sample was formed into an almost cylindrical shape having a thickness of 5 mm, and arranged so as to form an inner circumferential surface of the injection sleeve 1, as shown in FIG. 5 to FIG. 6. The injection sleeve 1 was arranged such that the axial direction extended along the horizontal direction, and molten metal was poured into the injection sleeve 1 through a pouring port 10 opened at the upper portion on the proximal end side. The poured molten metal was injected by a plunger tip 3 in the axial end direction (injected leftward from the right side in FIG. 5). The end side portion of the injection sleeve 1 communicated with a cavity (not shown) of a mold, and the molten metal was injected into the cavity by the plunger tip 3, and the cavity was filled with the molten metal.

The die-casting machine was operated under the condition that molten metal: ADC12, molten metal retention temperature (temperature of the molten metal poured through the pouring port 10): 690° C., an amount of poured molten metal: 0.8 kg, a material of the plunger tip 3: SKD61 (specified in JIS G 4404), tip lubricant: graphite-based, and an injection speed by the plunger tip 3: about 0.15 m/s were satisfied. About 26000 shots were performed for the sample 1, and 46500 shots were performed for the sample 2.

After the test, the inner circumferential surfaces of the injection sleeves 1 were checked, so that the inner circumferential surfaces of the respective injection sleeves 1 were confirmed to have similar sliding marks (sliding mark of the metal-based composite material 2 and the plunger tip 3).

An increased amount (an increased amount of the inner diameter indicated by L in FIG. 6) of the inner diameter in the up-down direction at each of a position (end portion on the axial end side of pouring port 10) indicated by A1 in FIG. 5, and a position (center position between the position A1 and the end portion of the injection sleeve 1) indicated by A2 was measured. The measurement results are indicated in Table 2.

TABLE 2

| | Increased amount of radius (mm) | |
|---|---|---|
| | A1 | A2 |
| Sample 1 | 0.14 | 0.20 |
| Sample 2 | 0.10 | 0.15 |

As indicated in Table 2, at both the positions A1 and A2, an increased amount of the inner diameter of the metal-based composite material 2 of the sample 2 was less than an increased amount in the sample 1. The inner diameter was increased due to wear caused by sliding of the metal-based composite material 2 and the plunger tip 3. Furthermore, the number of the shots for the sample 2 was much greater than the number of the shots for the sample 1. That is, the metal-based composite material 2 of the sample 2 was confirmed to have much more excellent wear resistance than the metal-based composite material of the sample 1.

The metal-based composite materials of examples advantageously exhibit excellent wear resistance and have the elongated lifespan when used, in particular, for the injection sleeve 1 of a die-casting machine.

The metal-based composite material of each example is a composite material having excellent hardness and strength. Since the hardness and strength are excellent, wear resistance is also high. Therefore, the metal-based composite material is more effectively applied to a member which requires high wear resistance, such as an injection sleeve of a die-casting machine.

Particularly, the metal-based composite material has excellent erosion resistance with respect to an aluminium alloy, has excellent temperature retaining capability due to the low thermal conductivity, and is more effectively applied to an injection sleeve of a die-casting machine used for die-casting of an aluminium alloy.

DESCRIPTION OF REFERENCE CHARACTERS

1: injection sleeve
2: metal-based composite material
3: plunger tip

The invention claimed is:

1. A metal-based composite material, wherein
the metal-based composite material is formed from a sintered body obtained only from Ti material powder containing Ti, Mo material powder containing Mo, Ni material powder containing Ni, and ceramics powder of at least one selected from SiC, TiC, $TiB_2$, and MoB, wherein
0.1 to 9 parts by mass of Ni is contained with respect to 100 parts by mass of the entirety of the metal-based composite material.

2. The metal-based composite material according to claim 1, wherein a porosity is not greater than 0.5%.

3. The metal-based composite material according to claim 1, wherein the metal-based composite material is nitrided.

4. The metal-based composite material according to claim 1, wherein 1 to 15 parts by mass of the ceramics powder is contained with respect to 100 parts by mass of the entirety of the metal-based composite material.

5. The metal-based composite material according to claim 1, wherein 3 to 10 parts by mass of the ceramics powder is contained with respect to 100 parts by mass of the entirety of the metal-based composite material.

6. The metal-based composite material according to claim 1, wherein 0.1 to 5 parts by mass of Ni is contained with respect to 100 parts by mass of the entirety of the metal-based composite material.

7. The metal-based composite material according to claim 1, wherein 0.5 to 3 parts by mass of Ni is contained with respect to 100 parts by mass of the entirety of the metal-based composite material.

* * * * *